US007922534B2

(12) United States Patent
Lin et al.

(10) Patent No.: US 7,922,534 B2
(45) Date of Patent: Apr. 12, 2011

(54) SOCKET CONNECTOR

(75) Inventors: Jeng-De Lin, Yorkville, IL (US); Qingwen Fang, Shanghai (CN)

(73) Assignee: Molex Incorporated, Lisle, IL (US)

( * ) Notice: Subject to any disclaimer, the term of this patent is extended or adjusted under 35 U.S.C. 154(b) by 236 days.

(21) Appl. No.: 12/087,830

(22) PCT Filed: Jan. 19, 2007

(86) PCT No.: PCT/US2007/001647

§ 371 (c)(1),
(2), (4) Date: Feb. 17, 2009

(87) PCT Pub. No.: WO2007/084764

PCT Pub. Date: Jul. 26, 2007

(65) Prior Publication Data

US 2009/0305575 A1 Dec. 10, 2009

(51) Int. Cl.
*H01R 13/648* (2006.01)

(52) U.S. Cl. ..... 439/607.27; 439/607.35; 439/607.53; 439/680; 439/544

(58) Field of Classification Search ..... 439/607.01, 439/607.27–607.28, 607.44–607.46, 607.53–607.55, 439/674, 677, 680–681, 544–545, 552, 557, 439/564–567, 76.1

See application file for complete search history.

(56) References Cited

U.S. PATENT DOCUMENTS 4,457,575 A 7/1984 Davis et al.
4,878,858 A 11/1989 Dechelette
6,257,924 B1 7/2001 Lund et al.
6,315,610 B1 * 11/2001 Zheng et al. ..... 439/607.11
6,908,339 B2 * 6/2005 Tanaka ..... 439/607.01
7,175,444 B2 * 2/2007 Lang et al. ..... 439/76.1
7,258,554 B1 * 8/2007 Yang ..... 439/76.1
7,524,213 B2 * 4/2009 Neer et al. ..... 439/680

FOREIGN PATENT DOCUMENTS

WO WO 00/51206 A1 8/2000

OTHER PUBLICATIONS

International Search Report for PCT/US07/001647, Mar. 7, 2007.

* cited by examiner

*Primary Examiner* — Xuong M Chung Trans
(74) *Attorney, Agent, or Firm* — Stephen L. Sheldon

(57) ABSTRACT

A receptacle connector is arranged on an interface of an electronic device for mating with a corresponding plug connector. An anti-incorrect-insertion block is arranged on and protruded from a mating portion of the plug connector. The receptacle connector comprises an insulating housing, conductive terminals assembled in the housing and a first shielding shell for covering on the outside of the insulating housing. A soldering portion welded to a circuit board is arranged on the lower edge of the first shielding shell. The receptacle connector is further provided with a second shielding shell for shielding the electromagnetic signals from the fool-proof opening of the interface. A receptacle connector of the invention shields the fool-proof opening by adding the second shielding shell, thereby preventing the electromagnetic leakage, improving the anti-electromagnetic interference capability of the connector and ensuring an electrical connection of the connector.

18 Claims, 9 Drawing Sheets

SOCKET CONNECTOR

FIELD OF THE INVENTION

The invention relates to a receptacle connector, and more particularly to a receptacle connector arranged within a computer and its periphery devices for mating with a corresponding plug connector and having an improved anti-electromagnetic interference capability.

BACKGROUND OF THE INVENTION

An existing connector for connecting various electronic devices, such as a computer main board and its peripheral devices or the like, comprises a receptacle connector assembled in a connection interface of a shell for an electronic device and the like, and a plug connector mating with said receptacle connector. FIG. 1 shows a receptacle connector assembled to a connection interface of a shell for an electronic device shell. The receptacle connector 10 comprises an insulating housing 101, conductive terminals arranged in the insulating housing 101 and a shielding shell 103 covering on the outside of the insulating housing 101. The receptacle connector 10 is fixedly connected to a circuit board 40, with an opening thereof for mating with a plug connector (not shown) corresponding to a connecting through-hole 201 of a connection interface 20 of an electronic device such as a computer or the like, the plug connector being electrically connected to the receptacle connector through the connecting through-hole 201.

However, with the development of the electronic devices such as a new type displayer and in order to be compatible with the existing connectors, a plug connector having an anti-incorrect-insertion mechanism has been recently developed. As shown in FIG. 2, the plug connector 30 comprises a housing 302, a mating portion 301 and a cable 303 respectively connected to both ends of the housing. A projecting block 304 for anti-incorrect-insertion is provided on the mating portion 301 for preventing incorrect insertion. The projecting block 304 of the plug connector 30 for connecting various electronic devices may vary in size. Accordingly, the connecting through-hole 201 of the connection interface 20 is provided with a corresponding fool-proof opening 202 through which the projecting block 304 of the plug connector passes, said fool-proof openings corresponding to the different projecting block 304 of the plug connector, as shown in FIGS. 3 and 4.

However, after the plug connector 30 of said structure has been inserted into the receptacle connector 10, the projecting block 304 of the mating portion 301 of the plug connector 30 will extend through the fool-proof opening 202 of the mating interface and thereby be exposed to outside the connector. Furthermore, the fool-proof opening 202 is a completely exposed opening without a plug connector 30 inserted therein. Thus, the electromagnetic signal will pass through the connection interface 20 from the fool-proof opening 202 to interfere the electronic components in the electronic devices and further to influence the anti-electromagnetic interference capability of the electronic devices.

SUMMARY OF THE INVENTION

The object of the invention is to provide a receptacle connector, which can prevent the interference caused by the electromagnetic waves leaking from a receptacle connector mating with a plug connector having an anti-incorrect-insertion mechanism, thereby improving the anti-electromagnetic interference capability in whole and ensuring an electrical connection of the electrical connector.

To achieve said object, a receptacle connector in accordance with the invention, is arranged on a circuit board within a connection interface of an electronic device for mating with a corresponding plug connector. The plug connector has a mating portion with an anti-incorrect-insertion block protruding therefrom. The connection interface is provided with a through-hole through which said mating portion of the plug connector passes, and a fool-proof opening through which the anti-incorrect-insertion block passes. The receptacle connector comprises an insulating housing, conductive terminals assembled in the insulating housing and a first shielding shell covering on the outside of the insulating housing. The receptacle connector further comprises a second shielding shell for shielding electromagnetic signals passing through the fool-proof opening of the connection interface.

Also, the second shield shell envelops the fool-proof opening of said connection interface.

After the receptacle connector mating with the plug connector, the second shielding shell envelops said anti-incorrect-insertion block passing through the connection interface.

Said second shielding shell is provided on the first shielding shell.

Furthermore, said second shielding shell is provided with a front opening.

Said second shielding shell has a top wall, a rear wall and two side walls which are connected with one another.

Furthermore, said second shielding shell has a fixing portion forming on each of the side walls.

The fixing portions of said second shielding shell are respectively formed by extending from the side walls along the top surface and downwardly of the two sides of the first shielding shell, and are welded to the circuit board.

Said fixing portions of said second shielding shell may also be in the form of two tabs extending outwardly at the front opening from the two side walls, respectively, and are fixedly attached to the connection interface.

Said fixing portions of said second shielding shell are formed by extending downwardly from two side walls and being bent so as to cover the bottom surface of the first shielding shell.

The advantages of the invention are as follows:

A connector in accordance with the invention prevents the interference caused by the electromagnetic leakage by adding a second shielding shell, shielding the fool-proof opening on the connection interface, and making the anti-incorrect-insertion block of a plug connector completely shielded by the second shielding shell after extending through the connection interface of the electronic devices, so that the anti-electromagnetic interference capability of the connector is improved in whole and an electrical connection of the electrical connector is secured.

BRIEF DESCRIPTION OF THE DRAWINGS

The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE INVENTION

Figure 1:
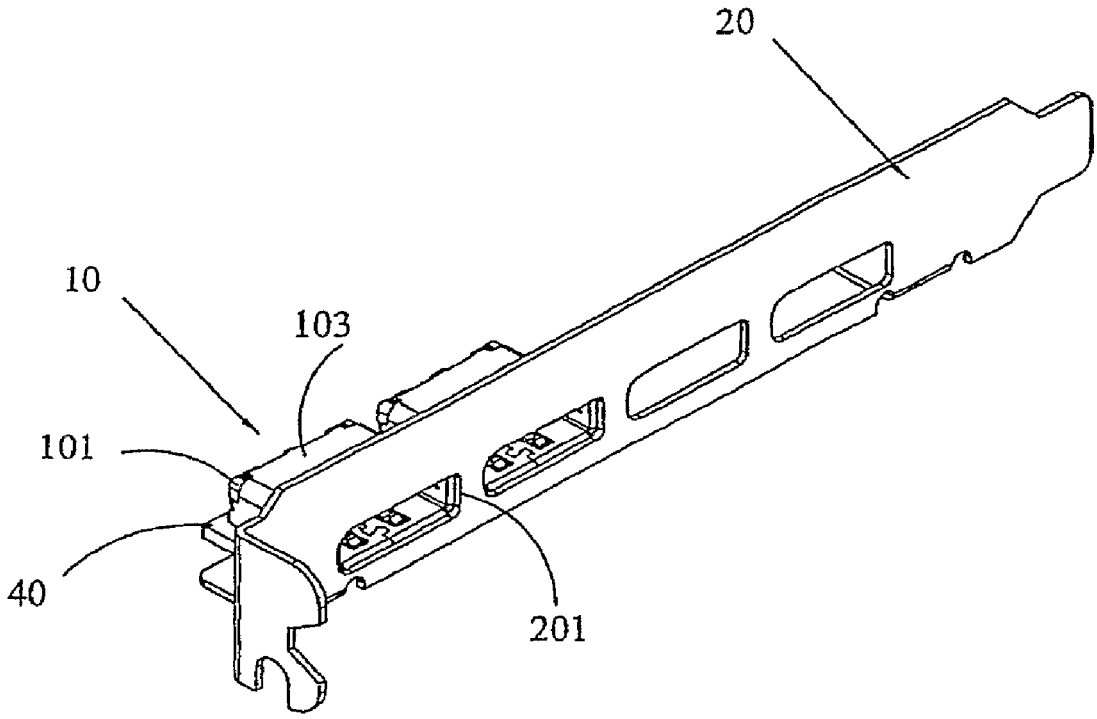
FIG. 1 is a schematic perspective view of a group of existing receptacle connectors assembled on a connection interface of an electronic device.
Figure 2:
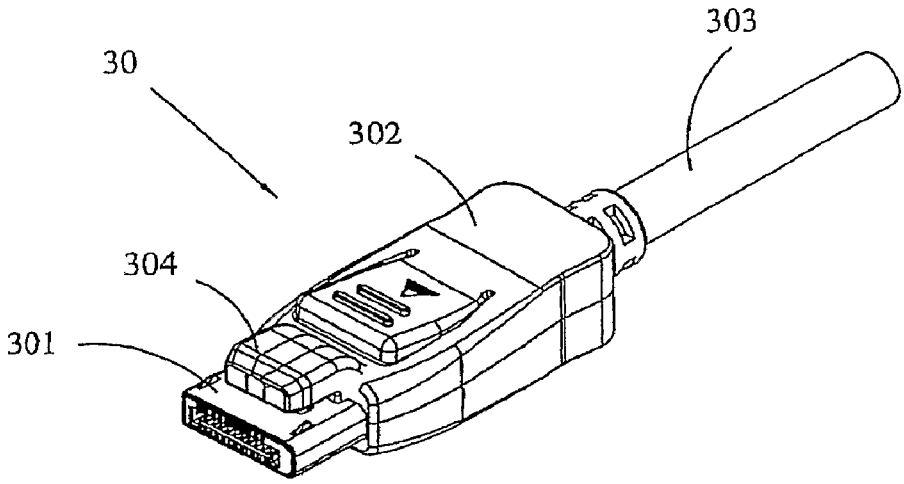
FIG. 2 is a schematic perspective view of a plug connector having an anti-incorrect-insertion mechanism.

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to that as illustrated.

Figure 5:
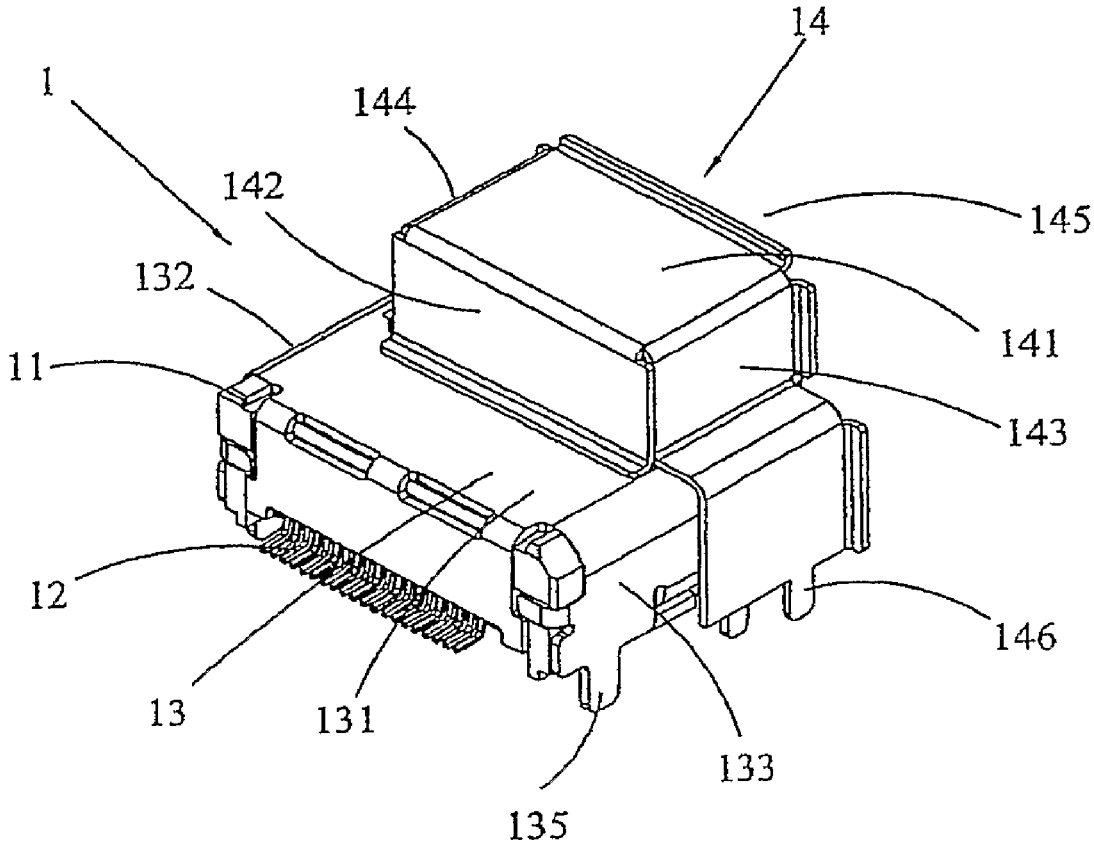
FIG. 5 is a schematic perspective view of an embodiment according to the invention.
Figure 6:
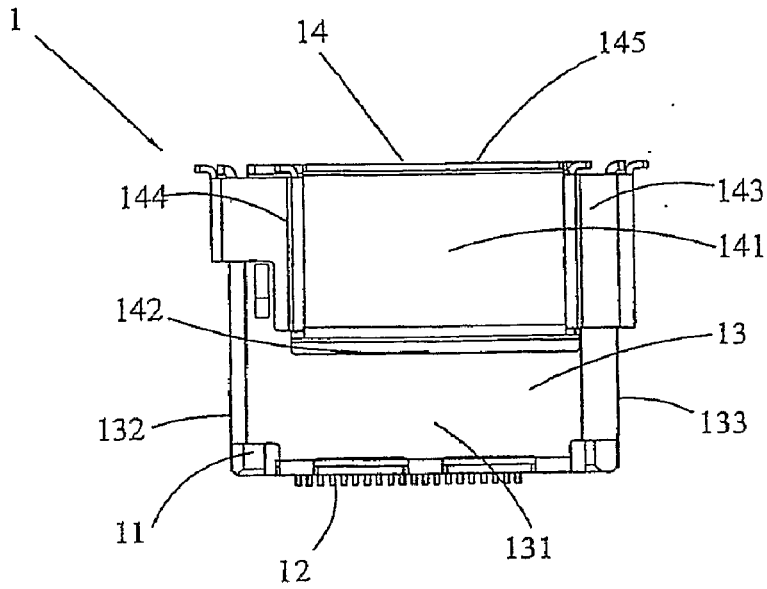
FIG. 6 is a top view of the embodiment in FIG. 5.
Figure 7:
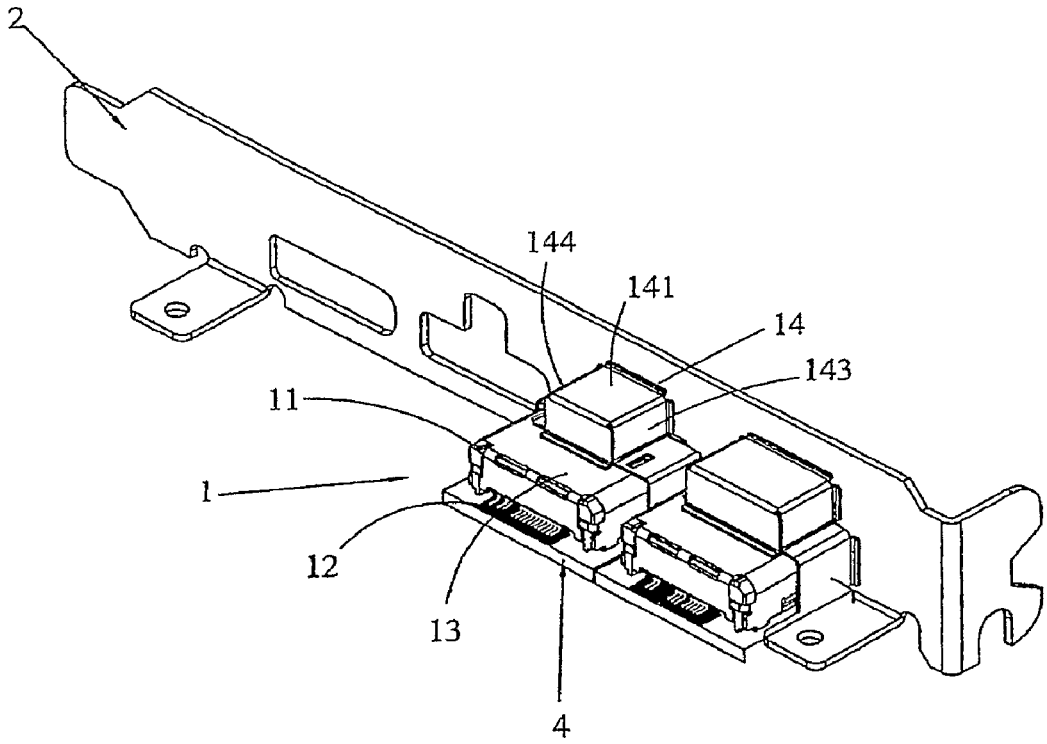
FIG. 7 is a schematic perspective view of a group of receptacle connectors according to the invention assembled on a connection interface of an electronic device.

Referring to FIGS. 5-7, a receptacle connector 1 according to the invention is provided for mating with a plug connector 30 (as disclosed in the background of the invention). The receptacle connector 1 is assembled on a circuit board 4 within a connection interface 2 of a shell for an electronic device such as a computer or the like. The receptacle connector 1 comprises an insulating housing 11 and conductive terminals 12 assembled in the insulating housing 11; a first shielding shell 13 covering on the outside of the insulating housing comprises a top wall 131 and two side walls 132, 133, wherein the lower edges of the side walls 132, 133 are extended to form soldering portions 134 and 135 and are soldered to the circuit board 4, respectively; a second shielding shell 14 stamped from a sheet metal, and riding over the first shielding shell 13, the second shielding shell 14 being in a form of a hollow rectangle parallelepiped and comprising a top wall 141, a rear wall 142 and two side walls 143, 144 which are connected with one another as well as a front opening 145 facing the interface 2, the lower edges of two side walls 143 and 144 of the second shielding shell 14 extending downwardly along the top surface 131 and two side walls 132, 133 of the first shielding shell 13 to form fixing portions 146, 147, which are welded to the circuit board 4 so that the second shielding shell 14 is fixedly attached to the circuit board 4.

Figure 3:
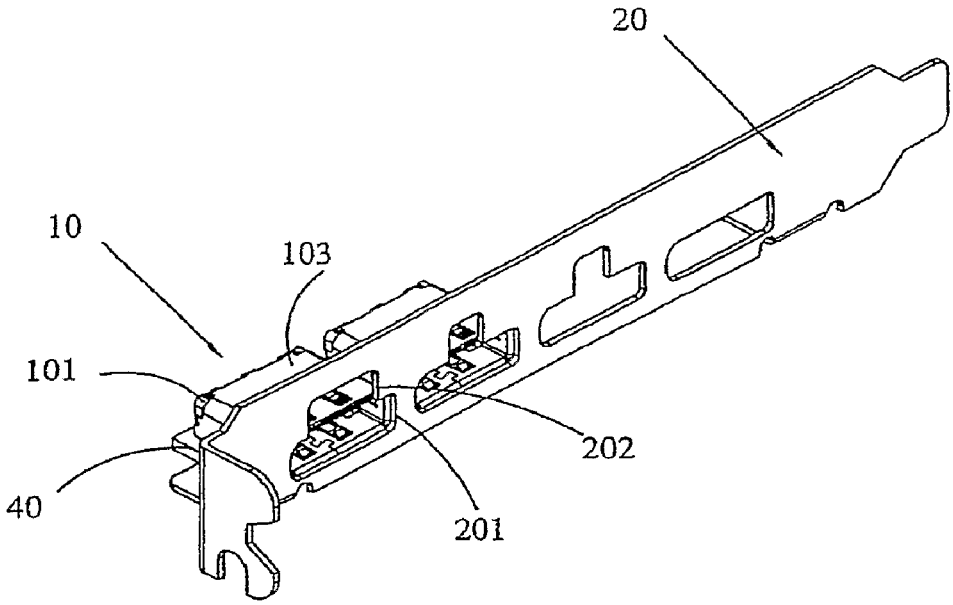
FIG. 3 is a schematic perspective view of a receptacle connector mating with the plug connector in FIG. 2.
Figure 4:
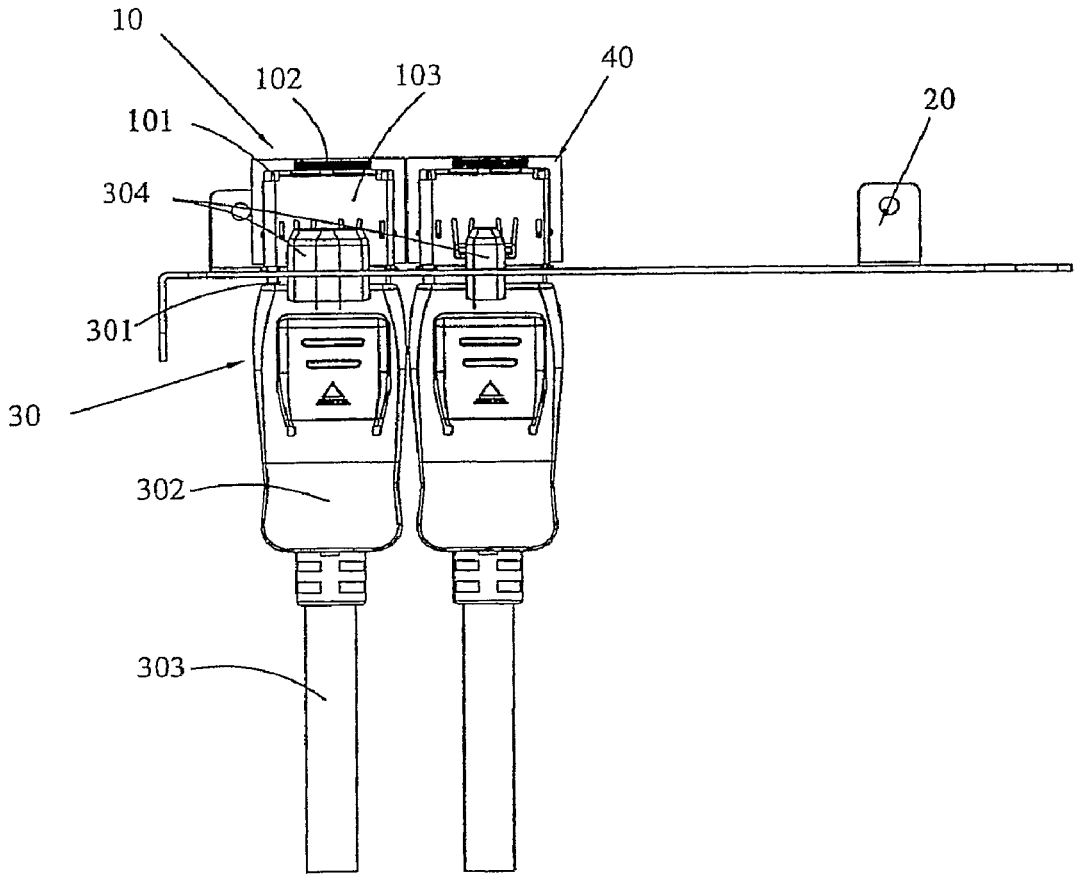
FIG. 4 is a top view of the receptacle connector in FIG. 3 into which the plug connector in FIG. 2 being inserted.

Referring to FIG. 3, the plug connector 30 mating with said receptacle connector 1 comprises an outer housing 302, a mating portion 301 and a cable 303 which are connected to two ends of the housing 302 respectively. Further, an anti-incorrect-insertion block 304 is provided by protruding from the mating portion 301, wherein the anti-incorrect-insertion block 304 on the plug connector 30 for connecting various electronic devices may vary in size. Correspondingly, the connection interface 2 is also provided with a plurality of through-holes 21, through which the mating portion 301 of the plug connector 30 passes, and a plurality of fool-proof openings 22, through which the anti-incorrect-insertion block 304 passes. The size and shape of the fool-proof openings 22 corresponds to that of the anti-incorrect-insertion block 304 for preventing anti-incorrect-insertion.

Figure 8:
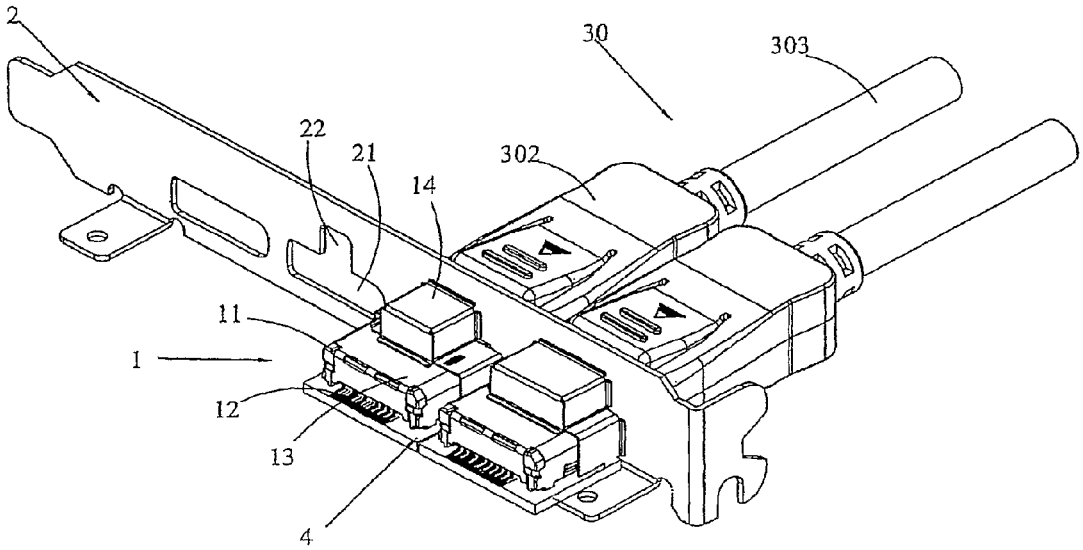
FIG. 8 is a schematic perspective view showing the status of the receptacle connector according to the invention mating with the corresponding plug connector.
Figure 9:
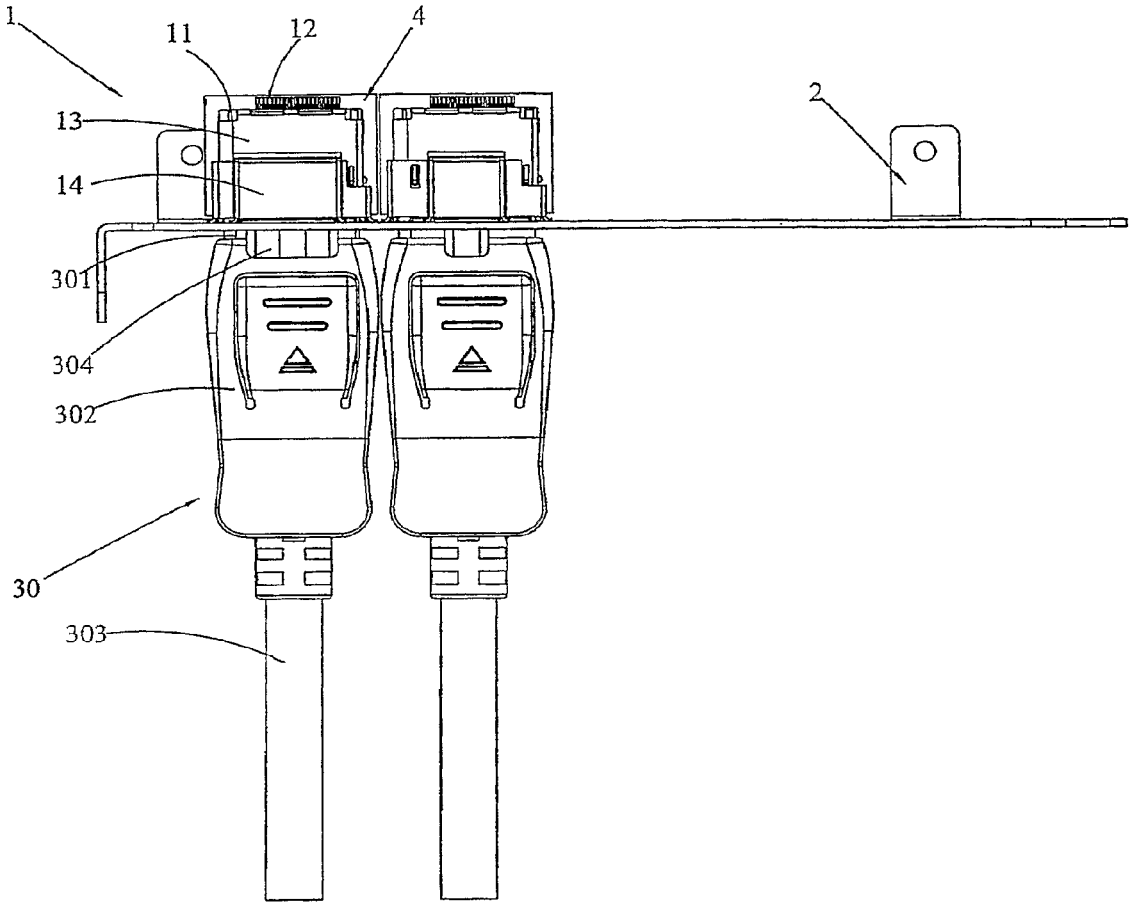
FIG. 9 is a top view of that of FIG. 8.

Referring to FIGS. 8 and 9, when the receptacle connector 1 is inserted into the plug connector 30, the mating portion 301 of the plug connector 30 is inserted into the electrical connector 1 through the through-hole 21 of the interface, and at the same time, the anti-incorrect-insertion block 304 on the mating portion 301 of the plug connector 30 passes through the fool-proof opening 22 of the interface 2 and then is accommodated in the second shielding shell 14 of the electrical connector 1, and the fool-proof opening 22 is completely enveloped by the second shielding shell 14 so that the electromagnetic signals passing through the fool-proof opening 22 are shielded, thereby preventing the electromagnetic wave leakage, improving the anti-electromagnetic interference capability of the electronic device and ensuring an electrical connection of the electrical connector.

The shape of the second shielding shell 14 may be not limited to said structure, and may be designed to be able to envelop the fool-proof opening 22 of the interface 2 and to accommodate an anti-incorrect-insertion block 304 of the mating portion 301 of the plug connector 30. The second shielding shell 14 of an electrical connector for connecting various electronic devices may have the same or different size.

Similarly, the fixing portions 146,147 of the second shielding shell 14 formed by extending from the side walls of the shell 14 are not limited to said structure.

Figure 10:
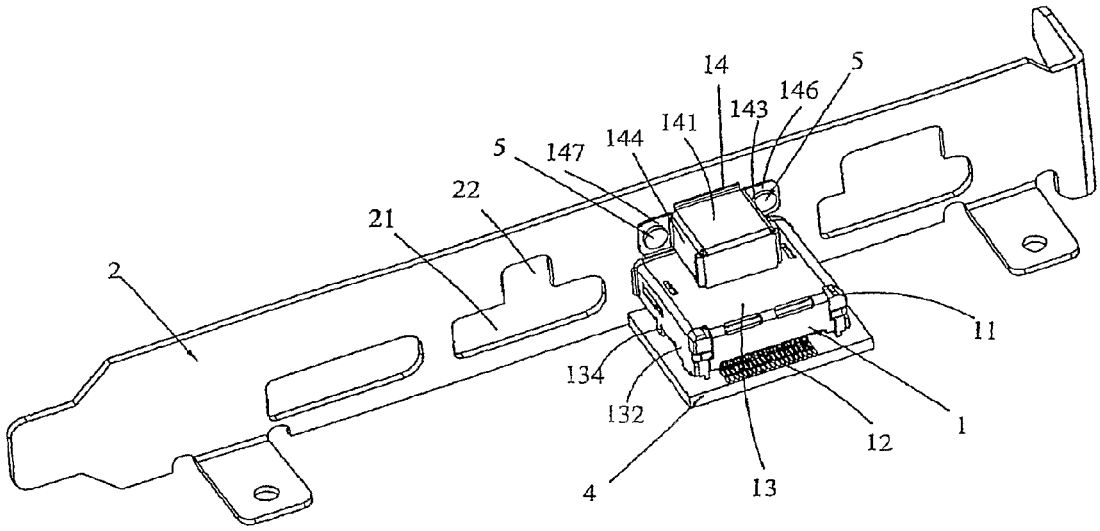
FIG. 10 is a schematic perspective view of another embodiment of the receptacle connector according to the invention.

Referring to FIG. 10, which shows a schematic view of the structure of another embodiment of the receptacle connector according to the invention, the fixing portions 146, 147 of said second shielding shell 14 is in the form of two tabs extending outwardly from the two side walls 143, 144 at the front opening 145 and is directly fixed on the interface 2 about the fool-proof opening 22 by a bolt 5 or a fixing means with the same function.

Figure 11:
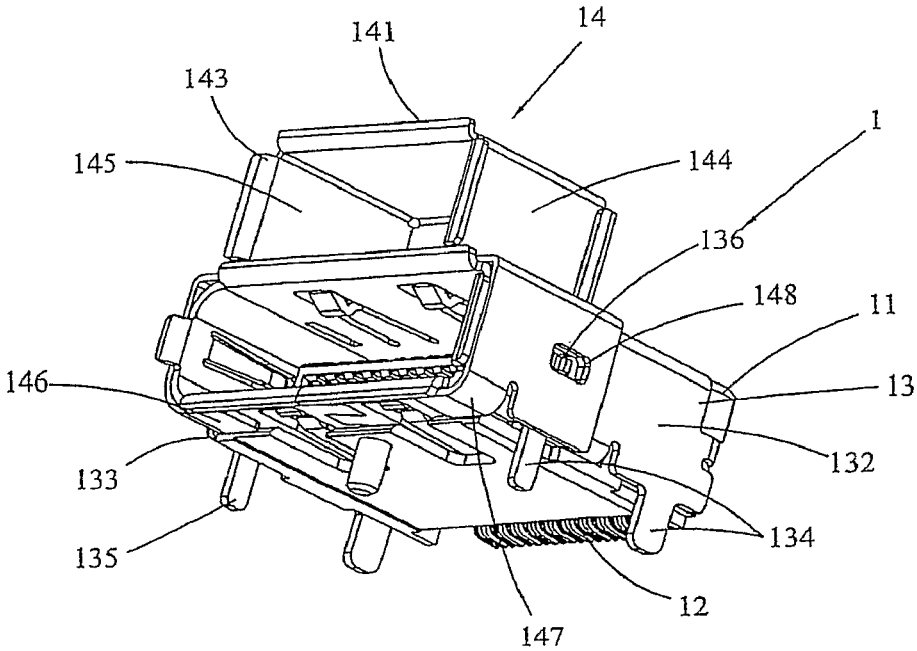
FIG. 11 is a schematic perspective view of a third embodiment of the receptacle connector according to the invention.
Figure 12:
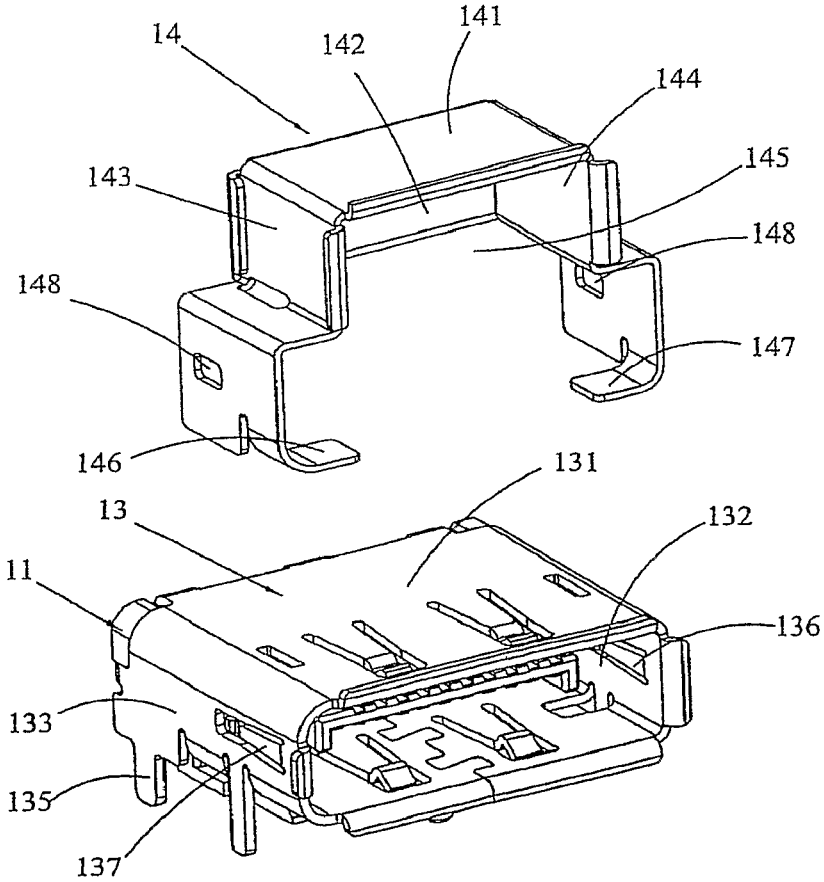
FIG. 12 is an exploded perspective view of that of FIG. 11.

Referring to FIGS. 11-12, the fixing portions 146, 147 of the second shielding shell 14 may be also formed by extending downwardly from two side walls 143, 144 and being bent so as to envelop the bottom surface of the first shielding shell 13. In addition, an opening 148 is provided respectively on two side walls 143, 144. Spring pieces 136, 137 are formed by stamping on the two side walls 132, 133 of the first shielding shell 13, respectively. When the fixing portions 146, 147 envelop the bottom surface of the first shielding shell 13, the ends of the spring pieces 136, 137 on the two side walls 132, 133 of the first shielding shell 13 can pass through the holes 148 of the side walls 143, 144 of the second shielding shell 14 while it elastically deforms outwardly under the insertion of a plug connector, so that the spring pieces 136, 137 on the side walls are protected from intervention.

While a preferred embodiment of the invention is shown and described, it is envisioned that those skilled in the art may devise various modifications without departing from the spirit and scope of the foregoing description and the appended claims.

The invention claimed is:

1. A receptacle connector adapted to mount to a circuit board and adapted to mate with a corresponding plug connector having a mating portion with a protuberant anti-incorrect-insertion block provided thereon, said receptacle connector further adapted for arrangement with a connection interface provided with a connecting through-hole, through which the mating portion of said plug connector passes, and a fool-proof opening, through which the anti-incorrect-insertion block passes, the receptacle connector comprising:

an insulating housing defining a mating portion receptacle;

conductive terminals assembled on the insulating housing;

a first shielding shell covering on the outside of the insulating housing; and a second shielding shell defining an anti-incorrect-insertion block receptacle.

2. A receptacle connector as claimed in claim 1, wherein said second shielding shell envelops the fool-proof opening of said interface.

3. A receptacle connector as claimed in claim 2, wherein the second shielding shell envelops said anti-incorrect-insertion block extending through the interface, when the receptacle connector is mated to the plug connector.

4. A receptacle connector as claimed in claim 1, wherein said second shielding shell is arranged on the first shielding shell.

5. A receptacle connector as claimed in claim 4, wherein said second shielding shell is provided with a front opening.

6. A receptacle connector as claimed in claim 5, wherein said second shielding shell has a top wall, a rear wall and two side walls which are connected with one another.

7. A receptacle connector as claimed in claim 5, wherein a fixing portion is formed from the side walls on said second shielding shell.

8. A receptacle connector as claimed in claim 7, wherein the fixing portion of said second shielding shell is formed by extending downwardly from the side walls thereof along the top wall and two side walls of the first shielding shell respectively, and is welded to the circuit board.

9. A receptacle connector as claimed in claim 7, wherein the fixing portion of said second shielding shell is in the form of two tabs extending outwardly from two side walls thereof at the front opening, which are attached to the interface.

10. A receptacle connector as claimed in claim 7, wherein the fixing portion of said second shielding shell is formed by extending downwardly from the two side walls and being bent so as to envelop the bottom face of the first shielding shell.

11. A receptacle connector as claimed in claim 1, wherein an opening to said mating portion receptacle is adjacent to and provided on the same plane as an opening to said anti-incorrect-insertion block receptacle.

12. A combination comprising:

a connection interface defining an opening, said opening having a mating portion and a fool-proof portion extending from said mating portion, said fool proof portion being dimensionally different than said mating portion;

a receptacle connector comprising an insulating housing defining a mating portion receptacle which is aligned with the mating portion of the opening of said connection interface, conductive terminals assembled on the insulating housing, a first shielding shell covering the outside of the insulating housing, and a second shielding shell attached to said housing and defining an anti-incorrect-insertion block receptacle which is aligned with said fool-proof portion of the opening of said connection interface; and a plug connector comprising a mating portion sized to fit within said mating portion receptacle of said receptacle connector and a protuberant anti-incorrect-insertion block thereon sized to fit within said anti-incorrect-insertion block receptacle of said receptacle connector.

13. The combination of claim 12, wherein said second shielding shell of said receptacle connector is arranged on the first shielding shell of said receptacle connector.

14. The combination of claim 12, wherein said second shielding shell of said receptacle connector has a top wall, a rear wall and two side walls which are connected with one another.

15. The combination of claim 14, wherein a fixing portion is formed on the side walls on said second shielding shell of said receptacle connector.

16. The combination of claim 15, wherein the fixing portion of said second shielding shell of said receptacle connector are formed by extending downwardly from the sidewalls thereof along a top wall and two sidewalls of the first shielding shell respectively, and are welded to an associated circuit board.

17. The combination of claim 15, wherein the fixing portion of said second shielding shell of said receptacle connector is in the form of two tabs extending outwardly from two sidewalls thereon and are attached to said connection interface.

18. The combination of claim 15, wherein the fixing portion of said second shielding shell of said receptacle connector is formed by extending downwardly from the two side walls and being bent so as to envelop the bottom face of the first shielding shell.

* * * * *